US010519020B2

(12) United States Patent
Ozawa et al.

(10) Patent No.: US 10,519,020 B2
(45) Date of Patent: Dec. 31, 2019

(54) BEVERAGE SERVER

(71) Applicant: GREEN HOUSE CO., LTD., Shibuya-ku, Tokyo (JP)

(72) Inventors: Takefumi Ozawa, Tokyo (JP); Arata Seki, Tokyo (JP)

(73) Assignee: GREEN HOUSE CO., LTD, Tokyo (JP)

( * ) Notice: Subject to any disclaimer, the term of this patent is extended or adjusted under 35 U.S.C. 154(b) by 0 days.

(21) Appl. No.: 16/091,715

(22) PCT Filed: Mar. 28, 2017

(86) PCT No.: PCT/JP2017/012632

§ 371 (c)(1),
(2) Date: Oct. 5, 2018

(87) PCT Pub. No.: WO2017/175626

PCT Pub. Date: Oct. 12, 2017

(65) Prior Publication Data

US 2019/0127199 A1 May 2, 2019

(30) Foreign Application Priority Data

Apr. 7, 2016 (JP) ..... 2016-077059
May 30, 2016 (JP) ..... 2016-107039

(51) Int. Cl.
*B67D 1/00* (2006.01)
*B67D 1/04* (2006.01)

(52) U.S. Cl.
CPC ..... *B67D 1/0021* (2013.01); *B67D 1/04* (2013.01)

(58) Field of Classification Search
CPC ..... B67D 1/0021; B67D 1/04
See application file for complete search history.

(56) References Cited

U.S. PATENT DOCUMENTS 3,271,974 A * 9/1966 Wheeler ..... B67D 1/0027 62/395
3,424,346 A * 1/1969 Fruehling ..... B67D 1/04 222/61
D491,580 S * 6/2004 Stoddart ..... D15/79
2016/0039653 A1* 2/2016 Jangbarwala ..... B67D 1/0041 222/1

FOREIGN PATENT DOCUMENTS

JP 2002-68379 A 3/2002
JP 2002-337991 11/2002

* cited by examiner

*Primary Examiner* — Jeremy Carroll
(74) *Attorney, Agent, or Firm* — W&C IP

(57) ABSTRACT

A beverage server including: a main body having a space, the main body having a top end opened; an inner lid disposed on an upper part of the main body; and an outer lid put on the top end of the main body with the inner lid covered, the outer lid being configured to make the space hermetic, wherein the inner lid has a plurality of liquid pumping pipes to be inserted into the space, and a beverage discharge pipe communicating with the liquid pumping pipes, the beverage discharge pipe being configured to discharge a beverage from the space to outside the main body, the outer lid has a pump configured to feed air to the hermetic space, and a manipulation member configured to switch between discharging a beverage and discharging no beverage, and the pump is operated by switching the manipulation member to discharging a beverage.

18 Claims, 18 Drawing Sheets

BEVERAGE SERVER

TECHNICAL FIELD

The present invention relates to a beverage server for pouring a beverage, such as canned beer, from a can into a cup, for example.

BACKGROUND ART

There are simple beverage servers for pouring a canned beverage from a can into a cup, for example. When an ultrasonic generator is built in a beverage server, this exerts an effect that carbonic acid bubbles become finer in pouring canned beer from a can into a cup, for example, to make beer more delicious. Beverage servers of this type are intended that people easily pretend to pour a beverage from an industrial-use beverage server at home, for example. In the beverage servers of this type that are conventionally widely used, one beverage can is mounted.

Suppose that when a beverage server that can accommodate a plurality of beverage cans and supply a beverage from the cans is available, the use of the server at parties or in the outdoors, for example, is thought, and the applications of the beverage server is widened. An example of the beverage server that can supply a beverage from a plurality of accommodated cans is disclosed in Patent Literature 1.

In a beverage server described in Patent Literature 1, a closed container is composed of a lower container and an upper container. The upper container includes two liquid pumping pipes inserted into two cans accommodated in the lower container, a valve mechanism, and a motor pump. When a manipulation part is manipulated, the motor pump is operated to increase the atmospheric pressure in the closed container, a beverage in the cans is pushed up through the liquid pumping pipes, and the beverage is supplied to the outside.

The beverage server described in Patent Literature 1 is roughly formed of the lower container and the upper container. The main mechanisms as the server, such as the liquid pumping pipes, the valve mechanism, and the motor pump, are installed on the upper container. Two liquid pumping pipes are joined on the under surface side of the upper container, and the joined pipe extends to the top surface side of the upper container to connect to a discharge pipe.

The beverage server described in Patent Literature 1 can accommodate a plurality of canned beverages. However, the beverage server described in Patent Literature 1 has a structure in which two liquid pumping pipes are joined to each other on the lower container side and the joining part hangs down from the upper container. Therefore, the dimensions of the upper container in the vertical direction are increased to upsize the server, and the position of the center of gravity is high, causing the server to be unstable. In the beverage server described in Patent Literature 1, most of main components including electric and electronic parts are gathered and disposed on the upper container, and hence the beverage server also has a problem that maintenance, such as cleaning after used, is difficult to be performed.

CITATION LIST

Patent Literature

Patent Literature 1: JP 2002-337991 A

SUMMARY OF INVENTION

Technical Problem

An object of the present invention is to provide a beverage server that is compact, of excellent operability, and of easy maintenance, such as cleaning after used, and that can accommodate a plurality of beverage cans.

Solution to Problem

The present invention is mainly characterized in that a beverage server includes:

a main body having a space, the main body having a top end opened;

an inner lid disposed on an upper part of the main body; and an outer lid put on the top end of the main body with the inner lid covered, the outer lid being configured to make the space hermetic, wherein the inner lid has a plurality of liquid pumping pipes to be inserted into the space, and a beverage discharge pipe communicating with the liquid pumping pipes, the beverage discharge pipe being configured to discharge a beverage from the space to outside the main body, the outer lid has a pump configured to feed air to the hermetic space, and a manipulation member configured to switch between discharging a beverage and discharging no beverage, and the pump is operated by switching the manipulation member to discharging a beverage.

Advantageous Effects of Invention

Beverage cans are accommodated in the can accommodation space of a main body, liquid pumping pipes are inserted into beverage cans, a cover formed of an inner lid and an outer lid is put on the upper part of the main body, and then advance preparations are finished. A structure is provided in which the cover is separated into the inner lid and the outer lid and the components other than the outer lid, i.e. the main body and the inner lid only have to be cleaned, and hence maintenance is easy.

DESCRIPTION OF EMBODIMENTS

In the following, embodiments of a beverage server according to the present invention will be described with reference to the drawings. The drawings depict embodiments of a beverage server that can accommodate six or two beverage cans. However, the number of accommodatable beverage cans only has to be plural numbers.

First Embodiment

Figure 1:
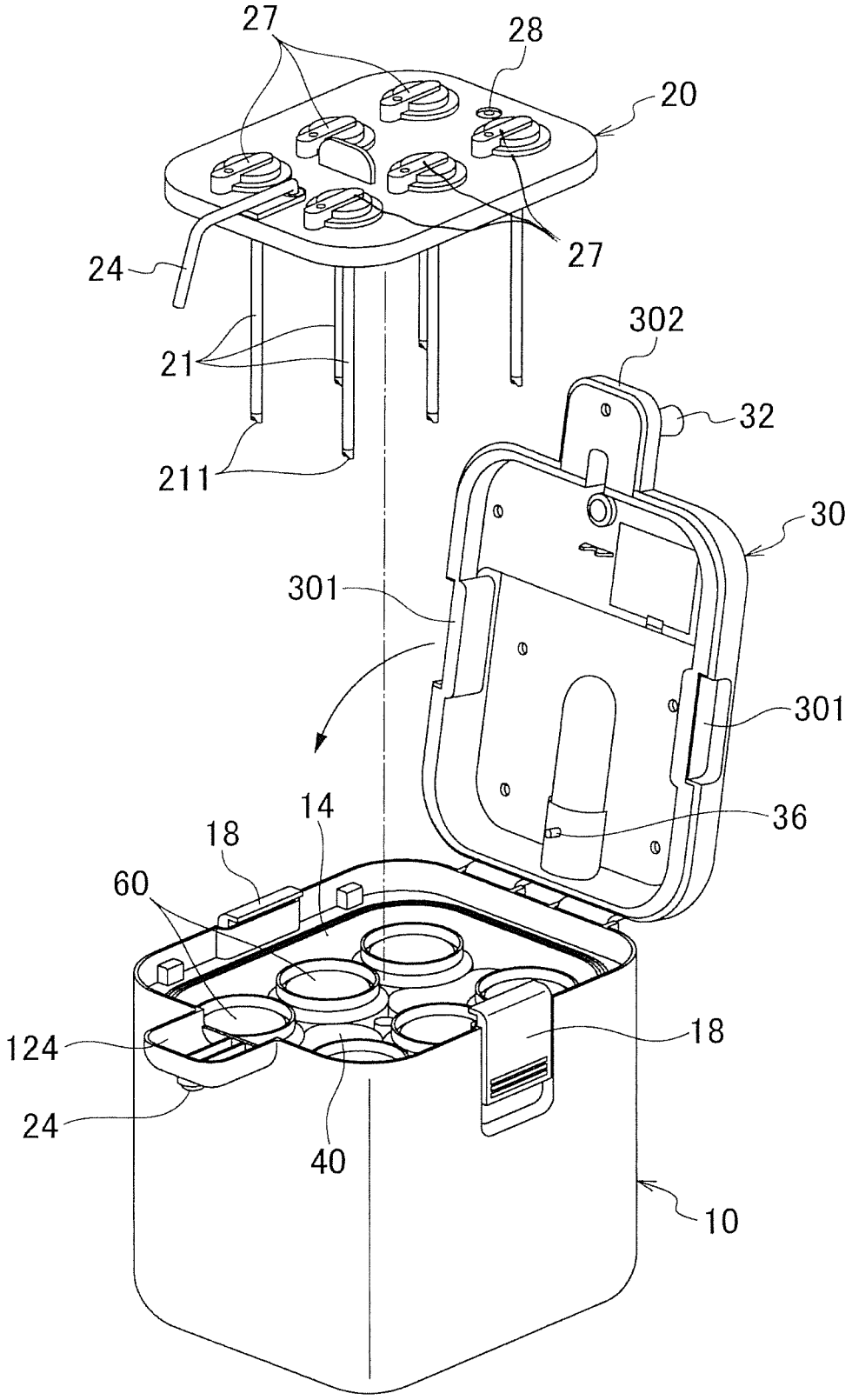
FIG. 1 is an exploded perspective view illustrating an embodiment of a beverage server according to the present invention.

As shown in FIG. 1, an embodiment of a beverage server according to the present invention can be roughly separated into amain body 10, an inner lid 20, and an outer lid 30. The main body 10 has a quadrilateral box shape with the top end opened, and has a can accommodation space 14 in which a plurality (six cans in the example in drawing) of beverage cans 60 can be accommodated. The inner lid 20 is disposed in the inside near the top end of the main body 10 in the state where the can accommodation space 14 is closed. The outer lid 30 is put on the top end portion of the main body 10 with the inner lid 20 covered to make the can accommodation space 14 hermetic.

[Structure of the Main Body 10]

Figure 4:
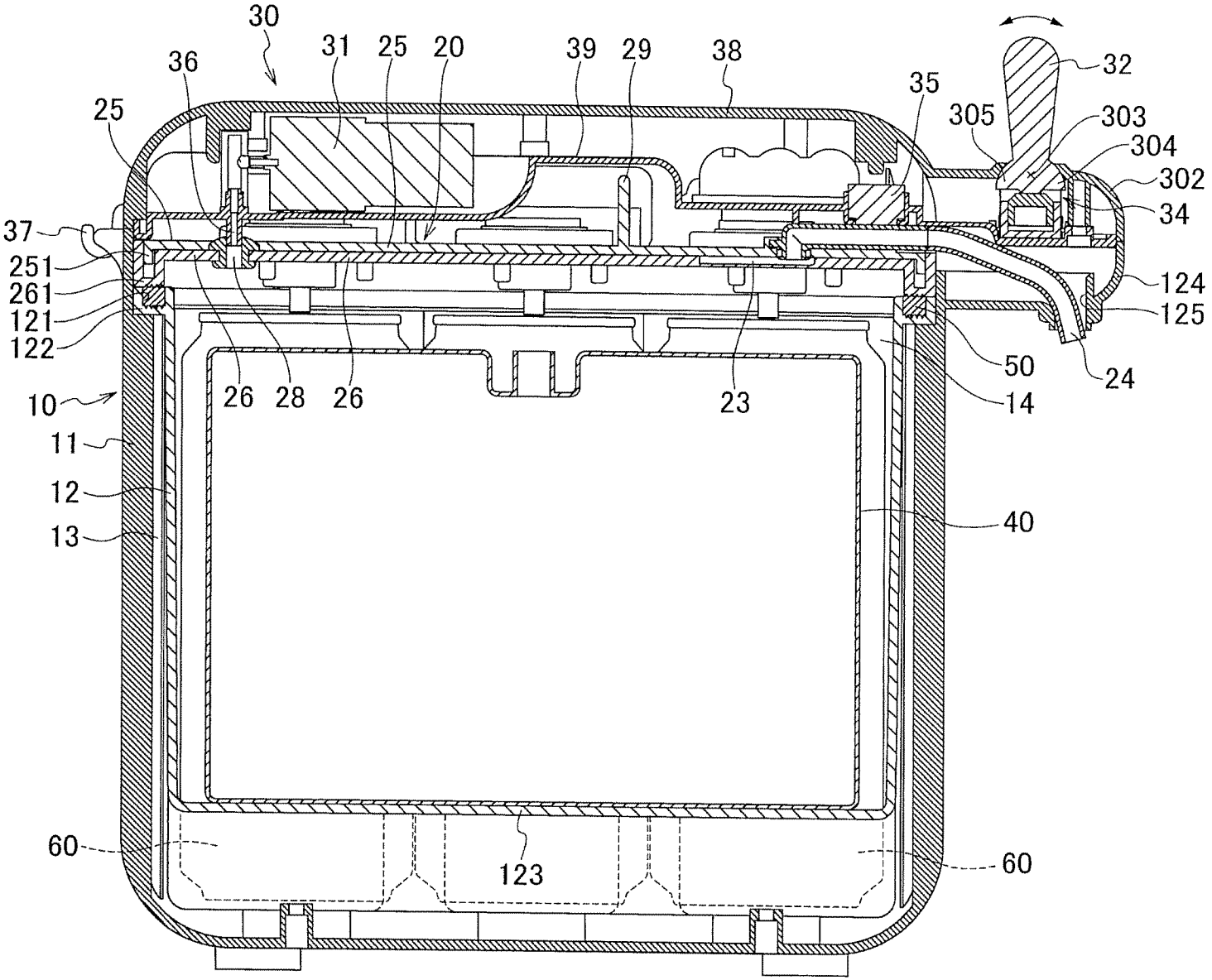
FIG. 4 is a left side cross sectional view at the center part of the embodiment.
Figure 5:
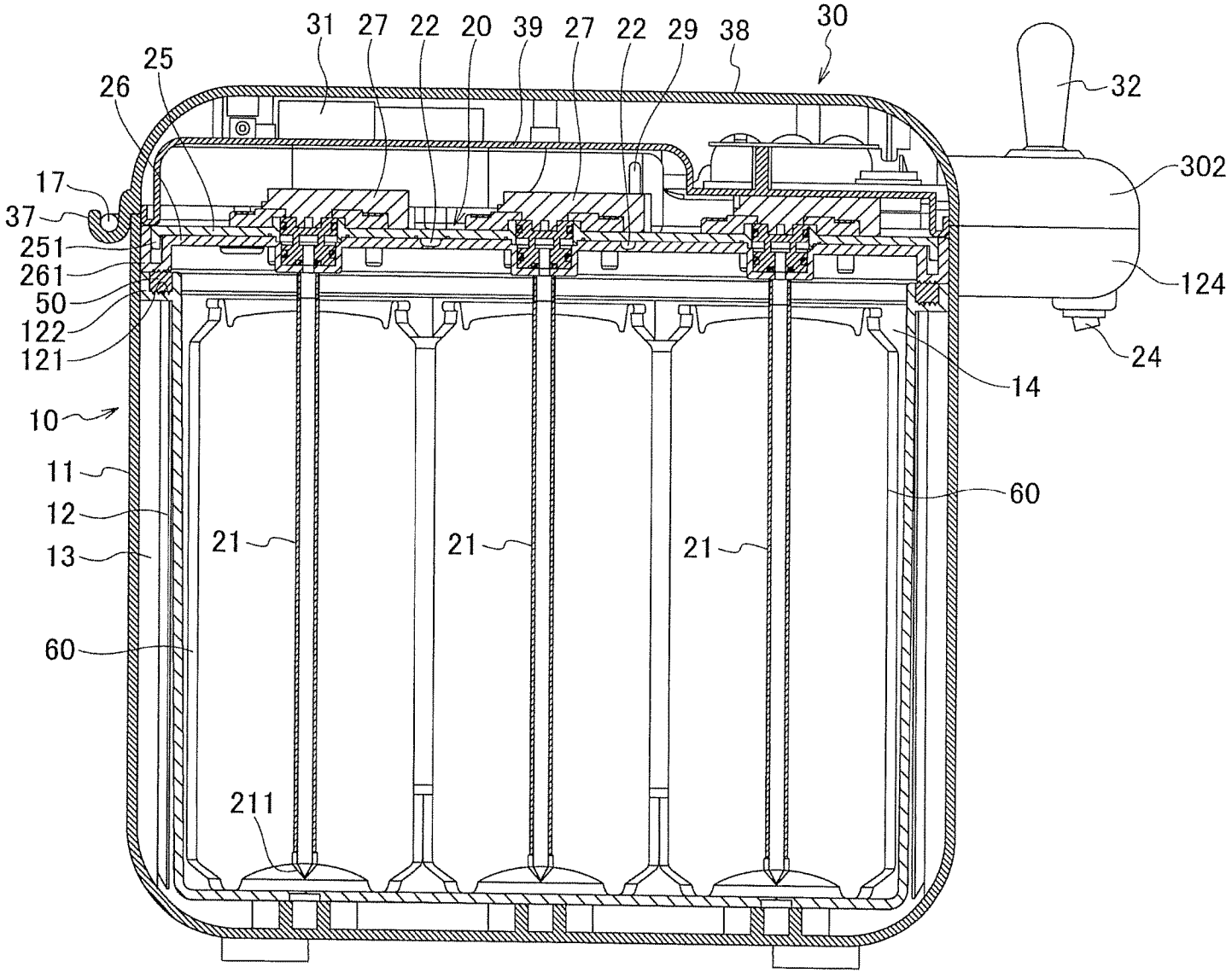
FIG. 5 is a left side cross sectional view of the embodiment cut at a position shifted from the position shown in FIG. 4.
Figure 6:
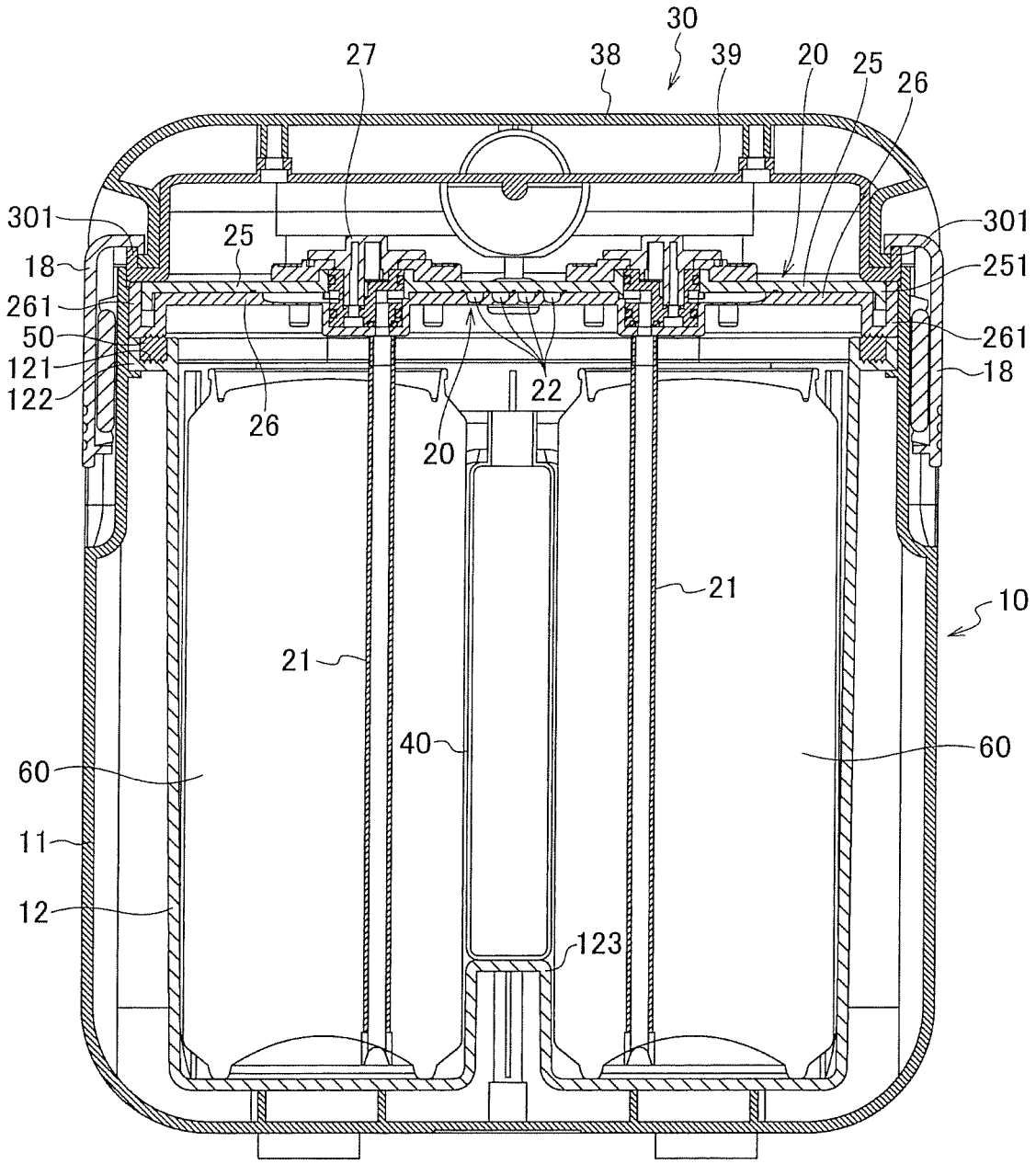
FIG. 6 is a front cross sectional view of the embodiment.

As shown in FIGS. 4 to 6, the main body 10 has a double structure formed of a bottomed outer wall 11 and an inner wall 12. A space 13 is formed between the outer wall 11 and the inner wall 12. The space 13 is filled with a heat insulator to improve the heat insulating effect of the main body 10. Both of the outer wall 11 and the inner wall 12 have the top end opened. The top end of the inner wall 12 is located lower than the top end of the outer wall 11.

Figure 7:
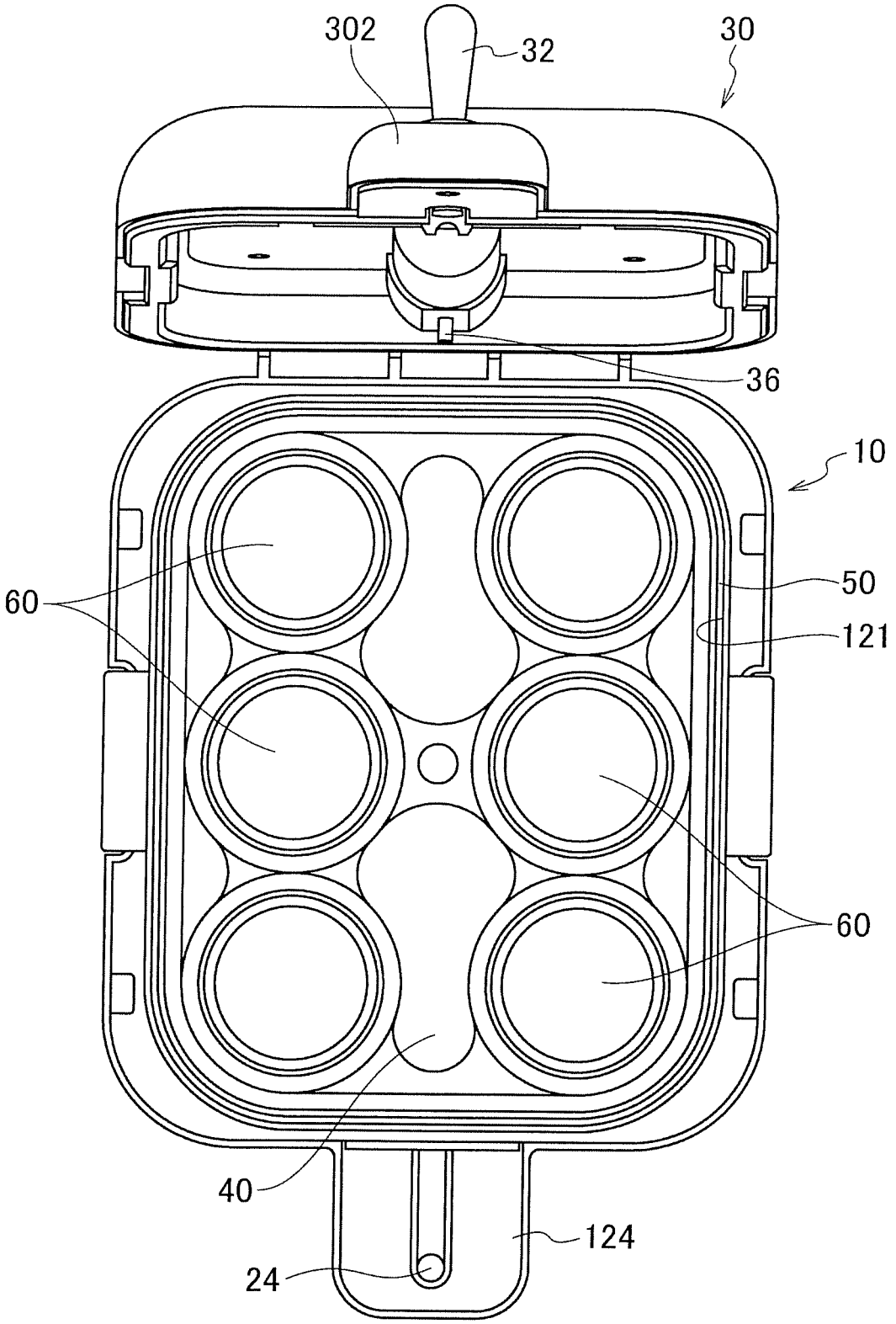
FIG. 7 is a plan view illustrating the embodiment in the state where an inner lid is removed and the outer lid is opened.
Figure 8:
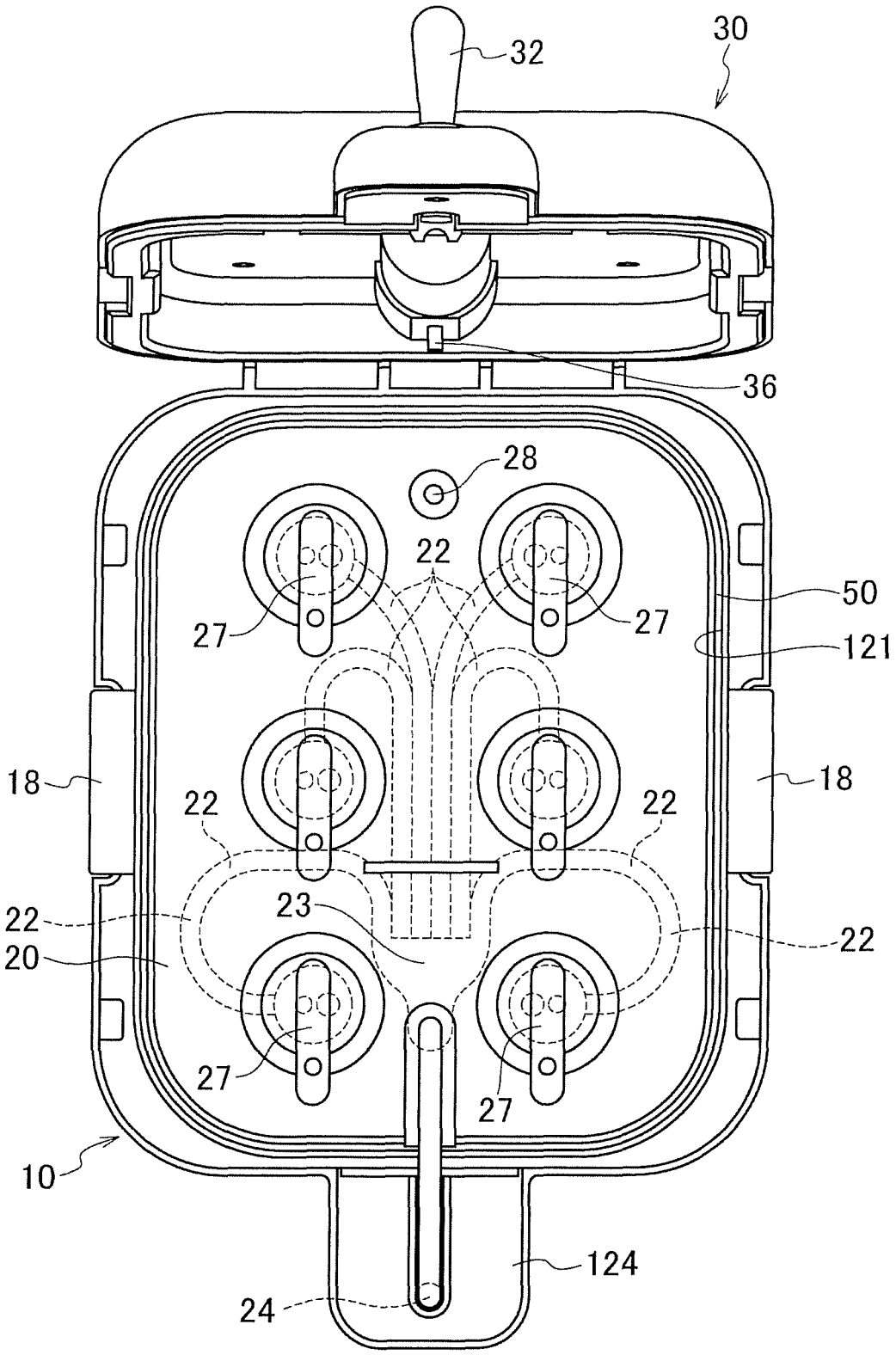
FIG. 8 is a plan view illustrating the embodiment in the state where the inner lid is disposed and the outer lid is opened.
Figure 9:
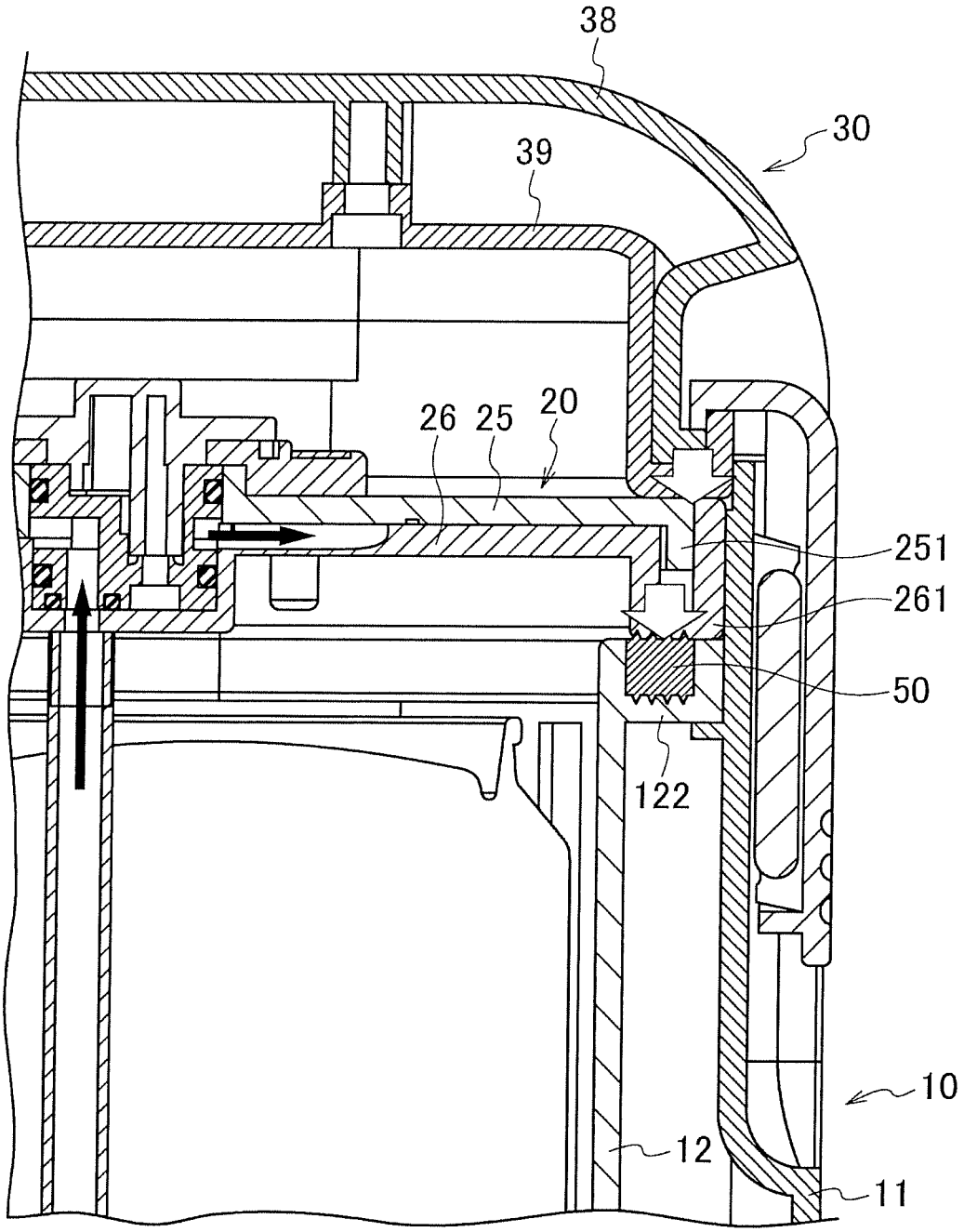
FIG. 9 is an enlarged side cross sectional view illustrating the hermetic structure portion of a can accommodation space of the embodiment.

The inner wall 12 has a collar 122 near the top end. The collar 122 extends outward on the entire circumference. The outer peripheral edge of the collar 122 vertically stands to the same height as that of the top end of the main body of the inner wall 12. A step is formed on the inner side near the top end of the outer wall 11, and the collar 122 is abutted against the step. A groove 121 is formed between the collar 122 and the top end portion of the main body of the inner wall 12. A packing 50 is buried in the groove 121. As also shown in FIGS. 7 and 8, the groove 121 and the packing 50 are provided on the entire circumference of the inner wall 12. The packing 50 has its top end portion extending upward above the collar 122 and the top end of the main body of the inner wall 12 in the natural state where no external force is applied.

The bottom portion of the inner wall 12 has an upward protrusion 123 in the width direction of the beverage server, i.e. in the center part in the lateral direction viewed from the front side. The protrusion 123 separates a column from a column where a plurality of beverage cans 60 is accommodated in the can accommodation space 14 of the main body 10 in columns, and the protrusion 123 functions as a support member for a low-temperature insulator 40.

On the outer wall 11 of the main body 10, a frontward protrusion 124 is integrally molded in the center part of the top end portion of the front surface in the lateral direction. The protrusion 124 has a dish-like shape with its top end opened, and holds a beverage discharge pipe 24. At the back-face-side top end portion of the outer wall 11 of the main body 10, a shaft 17 that is hooked on a hook 37 of the outer lid 30 is horizontally supported.

[Structure of the Inner Lid 20]

Next, the constitution of the inner lid 20 will be described in detail. As shown in FIGS. 4 to 6 and FIG. 9, the inner lid 20 has a structure in which an upper plate 25 is placed over a lower plate 26. The outer edge of the lower plate 26 is a downward projecting edge 261. The projecting edge 261 has a U-shaped cross section in which the outer edge of the lower plate 26 is bent downward at a right angle, bent horizontally outward at a right angle, and then bent upward at a right angle. The outer edge of the upper plate 25 is a downward projecting edge 251. The projecting edge 251 of the upper plate 25 is fit into the projecting edge 261 in a U-shaped cross section of the lower plate 26.

The upper plate 25 is integrated with the lower plate 26 in an intimate contact state by bonding, for example, and the plates 25 and 26 constitute the inner lid 20. The inner lid 20 has a shape such that the inner lid 20 can be fit into the inner side of the top end portion of the main body 10. The dimensions of the lid 5 are defined such that the projecting edge 261 of the lower plate 26 is abutted against the top surface of the packing 50. When the inner lid 20 is pressed downward, the packing 50 is compressed, and the main body 10 is hermetically joined to the inner lid 20.

From the under surface side of the inner lid 20, the liquid pumping pipes 21 in the number corresponding to the number of the beverage cans 60 accommodatable in the main body 10 hang down from the positions corresponding to the positions of the beverage cans to be accommodated. The liquid pumping pipes 21 have the projection length from the under surface of the inner lid 20 longer than the distance from the bottom surface of the inner lid 20 to the bottom of the beverage can 60 to be accommodated in the can accommodation space 14 of the main body 10. Tip end portions 211 of the liquid pumping pipes 21 are each diagonally cut from opposite sides and formed in a V-shape. The bottom portion of the beverage can 60 typically has its center part bulged in a dome shape, and has a groove around the dome. The tip end portion 211 of the liquid pumping pipe 21 inserted into the beverage can 60 slides along the dome-shaped bulge of the beverage can 60, and drops in the groove-shaped portion of the beverage can 60. Therefore, the beverage reserved in the groove-shaped portion can be drawn through the liquid pumping pipe 21, and the remaining amount of the beverage in the beverage can 60 can be reduced.

The inner lid 20 has a connecting passage 22 that carries the beverage pushed up from the liquid pumping pipe 21 to the outside of themainbody 10 and a joining part 23. The connecting passage 22 and the joining part 23 can be formed in which a groove or a recess is formed on at least one of the upper plate 25 and the lower plate 26 constituting the inner lid 20, the upper plate 25 is place over the lower plate 26 to join the plates 25 and 26 to each other, and then the groove or recess is blocked. In the example shown in the drawings, the connecting passage 22 is composed of the groove formed on the lower plate 26, and the joining part 23 is composed of the recess formed on the lower plate 26. The connecting passage 22 and the joining part 23 are blocked by the upper plate 25.

The liquid pumping pipes 21 individually communicate with the corresponding connecting passage 22, and the connecting passages 22 collectively communicate with the joining part 23. The internal space of the beverage discharge pipe 24 communicates with the joining part 23. As shown in FIG. 4, the beverage discharge pipe 24 penetrates through the upper plate 25, stands from the joining part 23, bends frontward horizontally along the top surface of the upper plate 25, and extends to the outside of the inner lid 20. When the inner lid 20 is mounted at a predetermined position on the main body 10, the beverage discharge pipe 24 extends from above the protrusion 124 of the main body 10 to diagonally downward, and protrudes from a guide hole 125 formed on the protrusion 124 to diagonally below to the front side.

The length and cross sectional area of the passages from the liquid pumping pipes 21 to the joining part 23 are equal such that the beverage is equally pushed up from the plurality of beverage cans 60. In the example shown in the drawings, as shown in FIG. 8, the connecting passages 22 corresponding to the beverage cans 60 near the joining part 23 are formed with a long bypass in the inner lid 20, and the connecting passages 22 corresponding to the beverage cans 60 far from the joining part 23 are formed in almost a straight line.

Figure 11:
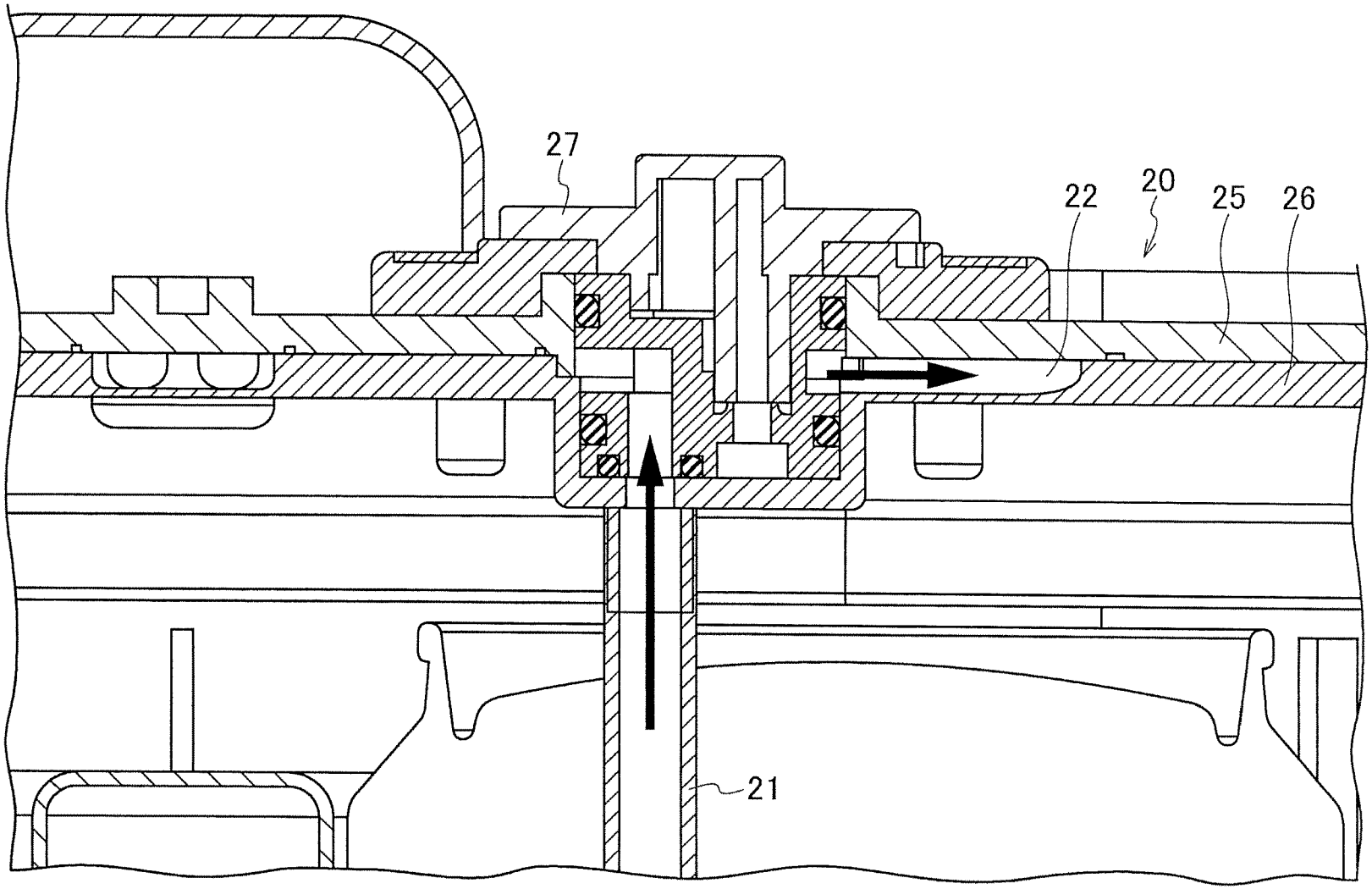
FIG. 11 is an enlarged side cross sectional view illustrating a valve portion that opens and closes a liquid pumping pipe of the embodiment.

The inner lid 20 has openable and closable valves 27 for the liquid pumping pipes 21 individually at the connecting parts of the liquid pumping pipes 21 to the connecting passages 22. The valves 27 each have the manipulation part on the top surface of the inner lid 20. The valves 27 are manually rotatable in the range of approximately 90 degrees in a horizontal plane. The portions connected from the liquid pumping pipes 21 to the connecting passages 22 can be opened and closed by rotating the valves 27. FIG. 11 shows manners of opening and closing the connecting part by rotating the valve 27. The valve 27 has a rotating portion rotated by rotation and a fixed portion. When the passage of the rotating portion is matched with the passage of the fixed portion, the valve 27 is opened, whereas when the passages of both portions are shifted to each other, the valve 27 is closed.

In the center in the width direction of the rear end portion of the inner lid 20, an air receiving port 28 is provided. The air receiving port 28 is formed by fitting a bushing-like member formed of an elastic material into a hole penetrating through the inner lid 20 in the thickness direction. An air supply pipe 36 of the outer lid 30 can be fit into the air receiving port 28.

The inner lid 20 is provided with a knob 29 by integrally molding the lid 20 with the upper plate 25. The knob 29 is pinched to hold the inner lid 20, and the inner lid 20 can be attached to or detached from the main body 10.

[Structure of the Outer Lid 30]

Next, the constitution of the outer lid 30 will be described in detail. As shown in FIGS. 4 and 5, the outer lid 30 has an upper outer plate 38 in a shape of a flat dish upside down and a bottom plate 39 fit into the lower end opening of the upper outer plate 38. The outer lid 30 is integrally formed with a hook 37 that engages with the shaft 17 of the main body 10 at the outer side of the rear end of the upper outer plate 38. The hook 37 is hooked from the lower side of the shaft 17, the outer lid 30 is rotated about the shaft 17, and hence the outer lid 30 can be put on the top end opening of the main body 10.

Figure 2:
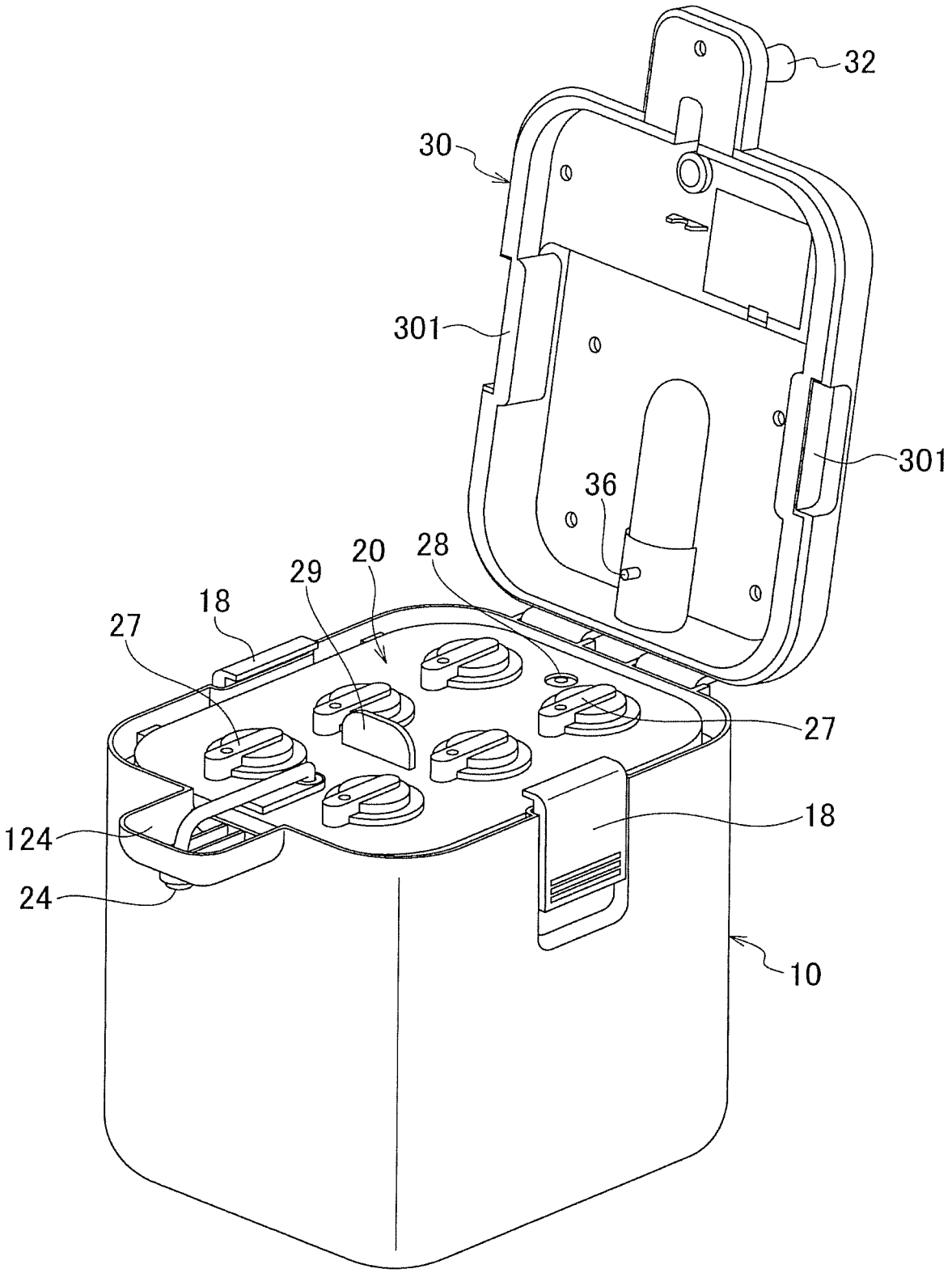
FIG. 2 is a perspective view illustrating the state where the outer lid of the embodiment is opened.
Figure 3:
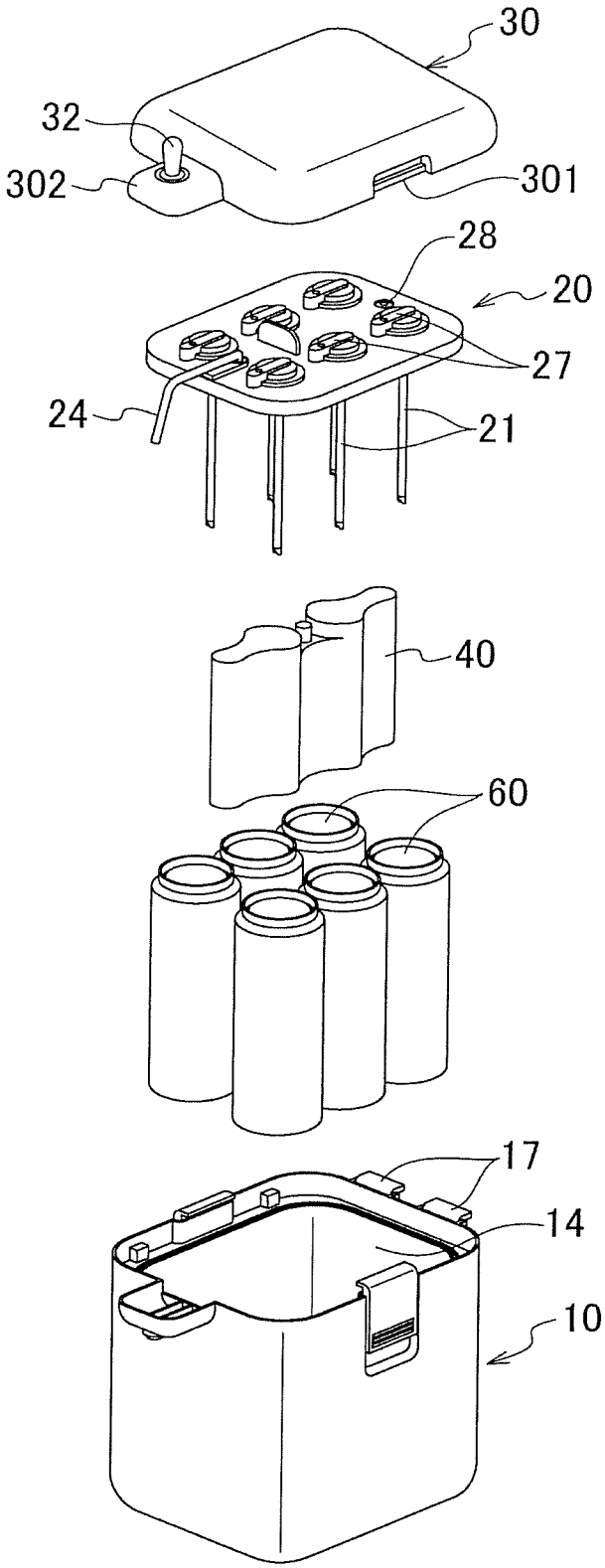
FIG. 3 is an exploded perspective view illustrating the embodiment including contents to a main body.

As shown in FIGS. 1 to 3, on the left and right sides of the outer lid 30, a hook 301 is formed to hook a buckle 18 provided on the left and right sides of the main body 10. The buckles 18 can bring the outer lid 30 to the main body 10 by hooking the hook 301 on the buckles 18 in a lock form. Since the structures of the buckles 18 and the hooks 301 are already widely known, the description is omitted.

As shown in FIG. 4, in the space formed between the upper outer plate 38 and the bottom plate 39, a pump 31 is installed in the rear part of the outer lid 30. The pump 31 is a motor that is driven by an electric motor to generate compressed air. The pump 31 is driven by a battery built in the outer lid 30. The compressed air generated by the pump 31 is supplied from the air supply pipe 36, described above, to the outside of the outer lid 30. The supply passage of the compressed air is branched to the air supply pipe 36 and another air supply pipe. The other air supply pipe communicates with an exhaust pipe 33 shown in FIG. 10.

When the outer lid 30 is put on the top end of the main body 10 and the buckles 18 are hooked on the hooks 301 to bring the outer lid 30 to the main body 10, the air supply pipe 36 is fit into the air receiving port 28 of the inner lid 20 as shown in FIG. 4. The edge of the inner lid 20 is pressed by the edge of the bottom plate 39 of the outer lid 30, and the projecting edge 261 of the inner lid 20 is pressed against the packing 50. Thus, the inner lid 20 is hermetically joined to the peripheral part of the main body 10, and the can accommodation space 14 of the main body 10 is hermetically kept. When the pump 31 is operated in this state, compressed air is supplied to the can accommodation space 14 of the main body 10 through the air supply pipe 36 and the air receiving port 28, and the atmospheric pressure in the can accommodation space 14 is increased.

The outer lid 30 has a protrusion 302 to be put on the protrusion 124 corresponding to the protrusion 124 of the main body 10. The protrusion 302 is provided with a knob-shaped manipulation member 32. The manipulation member 32 is supported by a shaft 303 and protrudes upward from the protrusion 302. The member 32 can be rotated about the shaft 303 in the longitudinal direction in a vertical plane. The manipulation member 32 is biased such that the member 32 maintains the neutral position in the vertically erected attitude, and when operating force is released from the rotation form in the longitudinal direction, the member 32 is returned to the neutral position.

The manipulation member 32 switches between discharging the beverage and discharging no beverage. The manipulation member 32 is operated interlocked with a switch. When the manipulation member 32 is longitudinally rotated, the switch is turned on, and when the member 32 is returned to the neutral position, the switch is turned off. When the switch is turned on, the pump 31 and an ultrasonic generator 35 are operated.

Figure 10:
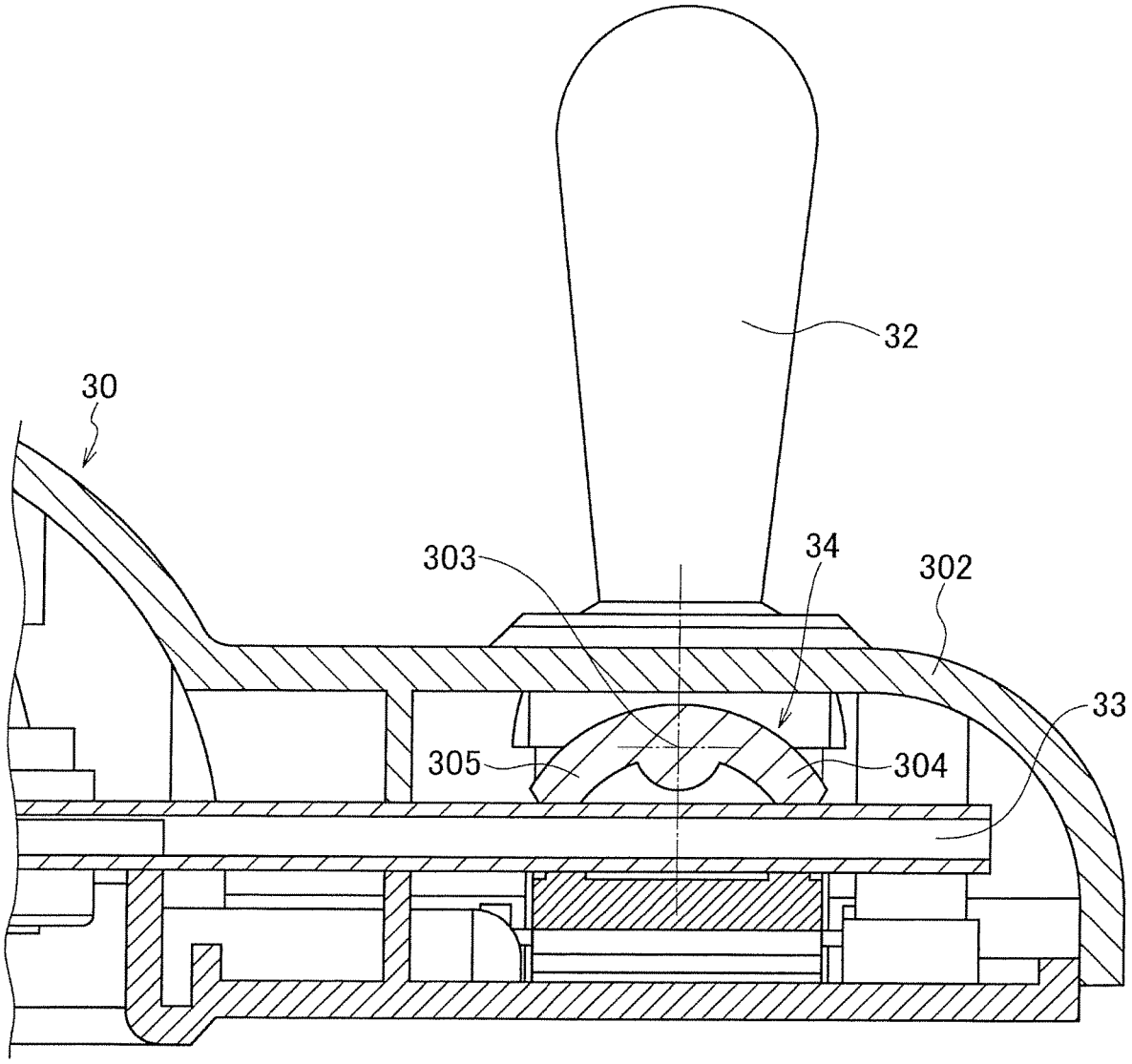
FIG. 10 is an enlarged side cross sectional view illustrating the opening and closing mechanism portion of an exhaust pipe of the embodiment.

Arms 304 and 305 extend diagonally downward to the front side and rear side of the shaft 303 in the lower part of the manipulation member 32. The arms 304 and 305 are integrated with the manipulation member 32. As shown in FIG. 10, the exhaust pipe 33 passes right close below the arms 304 and 305. The tip end of the exhaust pipe 33 is opened to the atmosphere in the outer lid 30. The exhaust pipe 33 is made of a flexible and resilient material. When the manipulation member 32 is longitudinally rotated, the exhaust pipe 33 is pressed and closed by the arm 304 or the arm 305. When the rotation force of the manipulation member 32 is released, the exhaust pipe 33 is opened. Components including the manipulation member 32 and the arms 304 and 305 constitute the opening and closing mechanism 34 of the exhaust pipe 33. As shown in FIG. 4, the beverage discharge pipe 24 is directed diagonally downward and reaches the guide hole 125 such that the beverage discharge pipe 24 on the inner lid 20 side does not interfere with the opening and closing mechanism 34 of the exhaust pipe 33.

As shown in FIG. 4, in the outer lid 30, the ultrasonic generator 35 is installed near the protrusion 302. The ultrasonic generator 35 is brought close to the beverage discharge pipe 24 in the state where the outer lid 30 is put on the main body 10 in intimate contact with the main body 10. The ultrasonic generator 35 is driven by the battery.

In this embodiment, as shown in FIGS. 1 to 3 and other drawings, six beverage cans 60 are accommodated in the can accommodation space 14 of the main body 10 so that three cans each are arranged in two columns. Between two columns of the beverage cans 60, a space is formed in a shape in which the partially cylindrical surfaces of three cans in the vertical direction are arranged on both sides. Into this space, the low-temperature insulator 40 that is fit into this space is inserted. The low-temperature insulator 40 is one having a well-known structure in which a refrigerant solution is sealed in a plastic container. The low-temperature insulator 40 is frozen in advance in a freezer. When the beverage server is used, the insulator 40 is inserted into a predetermined space in the main body 10. With this structure, the can accommodation space 14 of the main body 10 can be cooled for a long time.

As apparent from the description so far, the pump 31 and the ultrasonic generator 35 and electric components, such as a battery that drive the pump 31 and the generator 35, are installed in the outer lid 30 alone, and the main body 10 and the inner lid 20 have no electric components. In this type of beverage server, the portions to be easily dirty by use are the main body 10 and the inner lid 20, and the dirty portions are assumed to be washed in water. In the beverage server according to the embodiment, the outer lid 30 where electric components are installed is easily separated from the main body 10. That is, the outer lid 30 only has to be rotated about the shaft 17 of the main body 10 to remove the hook 37 of the outer lid 30 from the shaft 17 in the state where the top end of the main body 10 is opened. Thus, the main body 10, the inner lid 20, and the outer lid 30 are separated from each other, and then the inner lid 20 and the outer lid 30 only have to be washed in water. Since no electric components are installed in the inner lid 20 and the outer lid 30, no defect occurs in operation even though the lids 20 and 30 are washed in water, and hence maintenance is readily performed.

[Use Method and Operation of the First Embodiment]

Next, the use method for the beverage server according to the embodiment described so far and the operation in accordance with the method will be described. As shown in FIGS. 1 and 7 and other drawings, one or a plurality of beverage cans 60 is accommodated in the can space 14 of the main body 10. The openings with pull-tabs, for example, of the beverage cans 60 are opened in advance. Here, the case will be described in which beer cans are accommodated as the beverage cans 60.

The low-temperature insulator 40 is inserted between the columns of the beverage cans 60. FIGS. 7 and 8 show this state. Subsequently, the inner lid 20 is disposed on the top end opening of the main body 10, and the top end opening of the main body 10 is blocked. At this time, the liquid pumping pipes 21 are inserted from the opening into the corresponding beverage cans 60. In the case in which six beverage cans 60 are accommodated, all the valves 27 are opened. In the case in which the number of the beverage can 60 is less than six, the valve 27 corresponding to the liquid pumping pipe 21 that is not used is closed. Suppose that the valve 27 corresponding to the liquid pumping pipe 21 that is not used remains opened, the can accommodation space 14 of the main body 10 is opened to the atmospheric pressure through the liquid pumping pipe 21 that is not used, and the supply of the beverage, describe later, fails. FIG. 2 shows the state where the inner lid 20 is disposed on the main body 10.

Subsequently, the outer lid 30 is rotated about the shaft 17 of the main body 10, and put on the top end opening of the main body 10 with the inner lid 20 covered from above. The buckles 18 on the main body 10 side are hooked on the hooks 301 of the outer lid 30, and the outer lid 30 is brought to the main body 10 with the buckles 18. FIGS. 4 to 6 and FIG. 9 show this state. The outer lid 30 is brought to the main body 10 to press the top surface of the peripheral part of the inner lid 20 by the peripheral part of the outer lid 30, and the under surface of the peripheral part of the inner lid 20 is pressed against the peripheral part of the main body 10.

The packing 50 is present between the peripheral part of the inner lid 20 and the peripheral part of the main body 10, and hence the space defined by the main body 10 and the inner lid 20 is kept in the hermetic state. Even though the number of the beverage cans 60 to be accommodated in the main body 10 is less than six, the valve 27 corresponding to the liquid pumping pipe 21 that is not used is closed, and hence the can accommodation space 14 of the main body 10 does not communicate with the outside air through the liquid pumping pipe 21.

When the manipulation member 32 is rotated in this state such that the member 32 is tilted frontward or backward, as shown in FIG. 10, the opening and closing mechanism 34 of the exhaust pipe 33 is also operated, the arm 304 or the arm 305 flattens the exhaust pipe 33, and the exhaust pipe 33 is closed. Closing the exhaust pipe 33 makes the can accommodation space 14 of the main body 10 a hermetic space. At the same time when the exhaust pipe 33 is closed, the pump 31 and the ultrasonic generator 35 start operation. The operation of the pump 31 feeds air to the can accommodation space 14 of the main body 10 through the air supply pipe 36 and the air receiving port 28, and the atmospheric pressure in the can accommodation space 14 is increased.

An increase in the atmospheric pressure in the can accommodation space 14 applies a pressure to the top surface of beer in the beverage cans 60, and the beer in the beverage cans 60 is pushed up along the liquid pumping pipes 21. The beer that is pushed up reaches the joining part 23 through the connecting passages 22 shown in FIG. 8, and the beer is discharged to the outside through the beverage discharge pipe 24. When the beer passes through the beverage discharge pipe 24, ultrasonic vibrations are applied to the beer by the operation of the ultrasonic generator 35, and the beer is discharged with fine carbonic acid bubbles. When the beer is received by a cup, the beer is covered with fine bubbles, and much tastier beer can be drunk more than directly drinking beer from the beverage can 60.

After a proper amount of beer is supplied, the rotation of the manipulation member 32 is stopped, and the manipulation member 32 is returned to the neutral position by biasing force. Returning the manipulation member 32 stops the operation of the pump 31 and the ultrasonic generator 35, and the supply of beer from the beverage cans 60 is stopped. Returning the manipulation member 32 to the neutral position returns the opening and closing mechanism 34 shown in FIG. 10 at the original position to release the exhaust pipe 33, and the can accommodation space 14 of the main body 10 is opened to the atmospheric pressure. Consequently, immediately after the pump 31 is stopped, the supply of beer is stopped. Suppose that the opening and closing mechanism 34 is absent, it takes time to return the pressure in the can accommodation space 14 of the main body 10 to the atmospheric pressure, causing so-called dripping from the beverage discharge pipe 24, which is undesirable.

[Effect Obtained from the Beverage Server According to the First Embodiment]

In accordance with the beverage server according to the embodiment described above, the following effect can be obtained.

The main components are separated into the main body 10, the inner lid 20, and the outer lid 30, and the liquid pumping pipe 21 that draws the beverage in the beverage cans 60 is provided on the inner lid 20. Thus, even though the number of the beverage cans 60 to be accommodated in the main body 10 is increased, preparation is readily performed.

When the outer lid 30 is put on the top end of the main body 10 with the inner lid 20 covered, the hermeticity of the can accommodation space 14 of the main body 10 is maintained to enable the supply of the beverage. Also from this point, preparation is easy.

In the case in which the number of the beverage cans 60 is less than the accommodatable number of the cans 60 in the can accommodation space 14 of the main body 10, the valve 27 corresponding to the liquid pumping pipe 21 that is not used only has to be operated to close the supply passage of the beverage to the liquid pumping pipe 21. The operation of the valve 27 is easy.

A structure is formed in which the entire accommodation space 14 of the main body 10 is turned to the hermetic state, air is fed to the can accommodation space 14 to supply the beverage in the beverage cans 60, and hence even though the beverage cans 60 in different sizes are present, the beverage can be supplied from the beverage cans 60.

The passages of the beverage from the liquid pumping pipes 21 to the beverage discharge pipe 24 have equal cross sections and equal overall lengths, and hence the beverage can be equally supplied from the beverage cans 60.

The other effects are described in the specific description of the embodiments, and can be estimated from the specific description, and the description is omitted.

Second Embodiment

Next, a second embodiment of a beverage server shown in FIGS. 12 to 14 will be described. The main point of the second embodiment different from the first embodiment is a constitution from liquid pumping pipes to a joining part in which the liquid pumping pipes also serve as the connecting passages 22 of the first embodiment. Note that since the constitutions of a main body and an outer lid are the same as the constitutions of the main body 10 and the outer lid 30 of the first embodiment, the detailed description of the main body and the outer lid is omitted.

Figure 12:
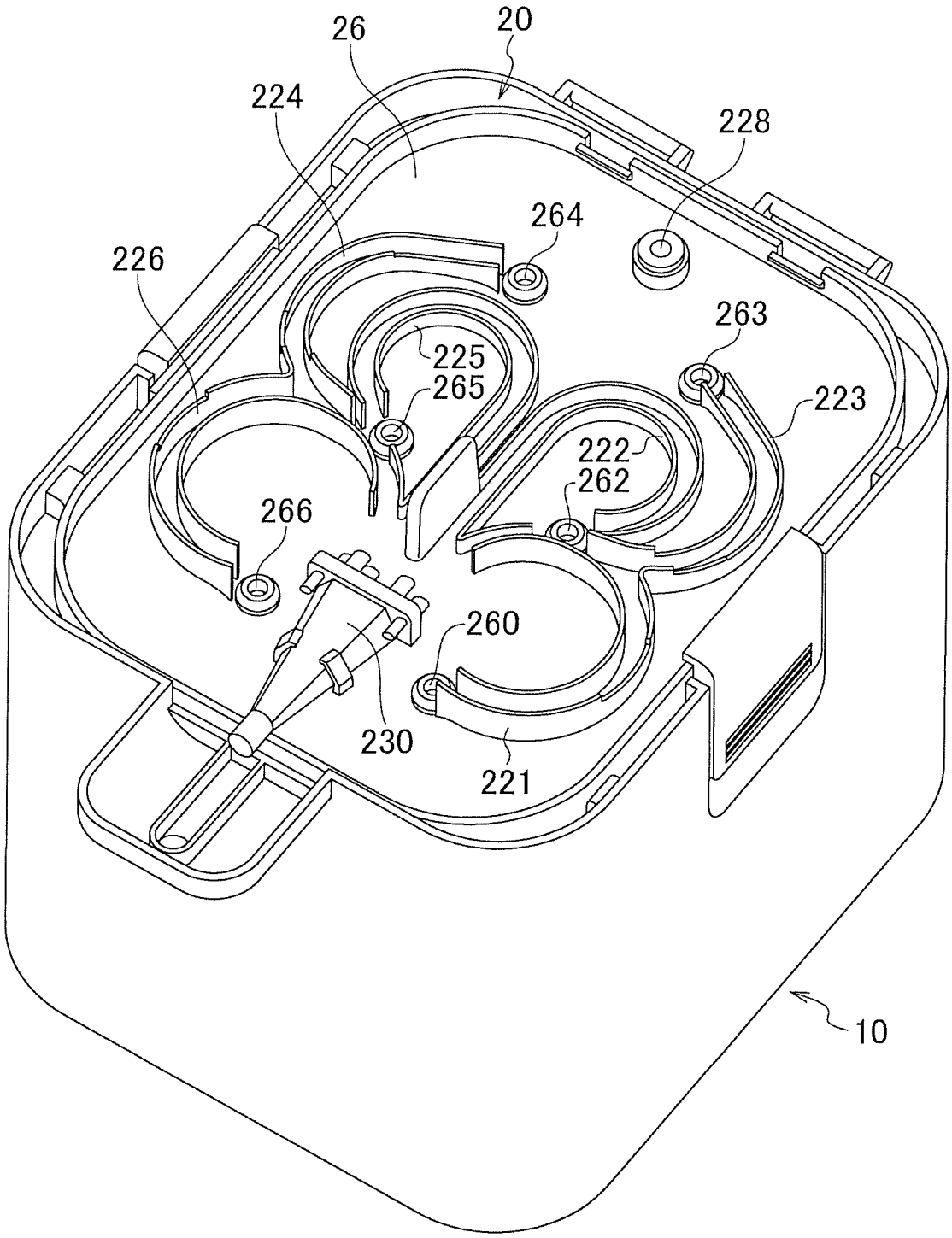
FIG. 12 is a perspective view of a second embodiment of a beverage server according to the present invention, illustrating the state where the upper plate of an inner lid and liquid pumping pipes are removed.
Figure 13:
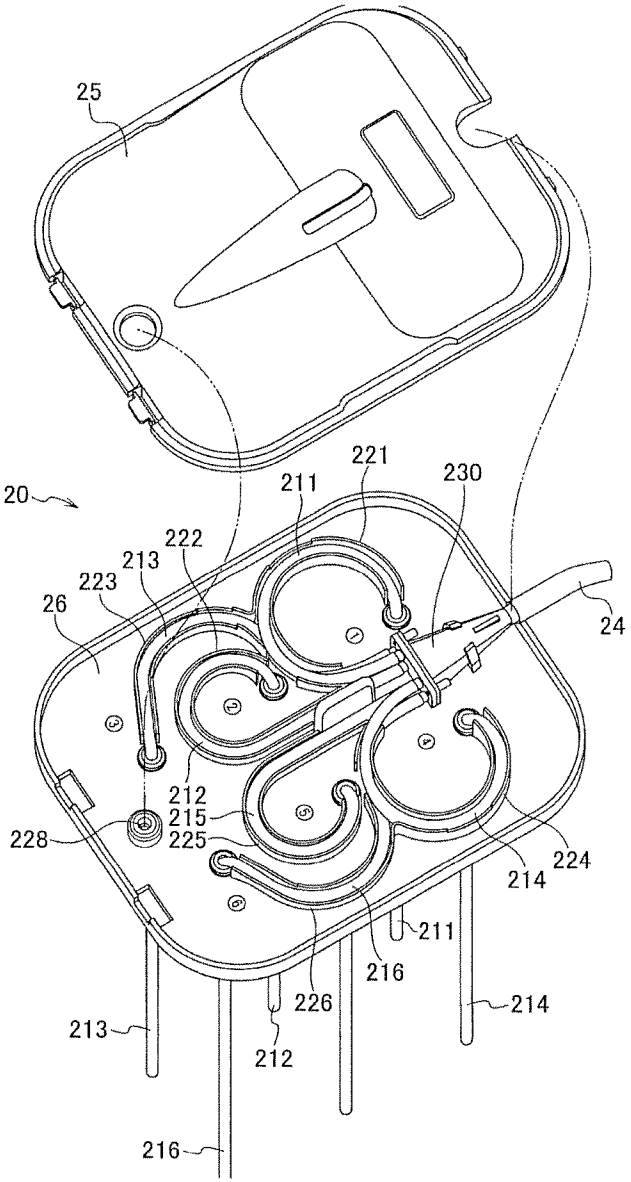
FIG. 13 is a perspective view illustrating the state where the inner lid of the second embodiment is separated into the upper plate and a lower plate.
Figure 14:
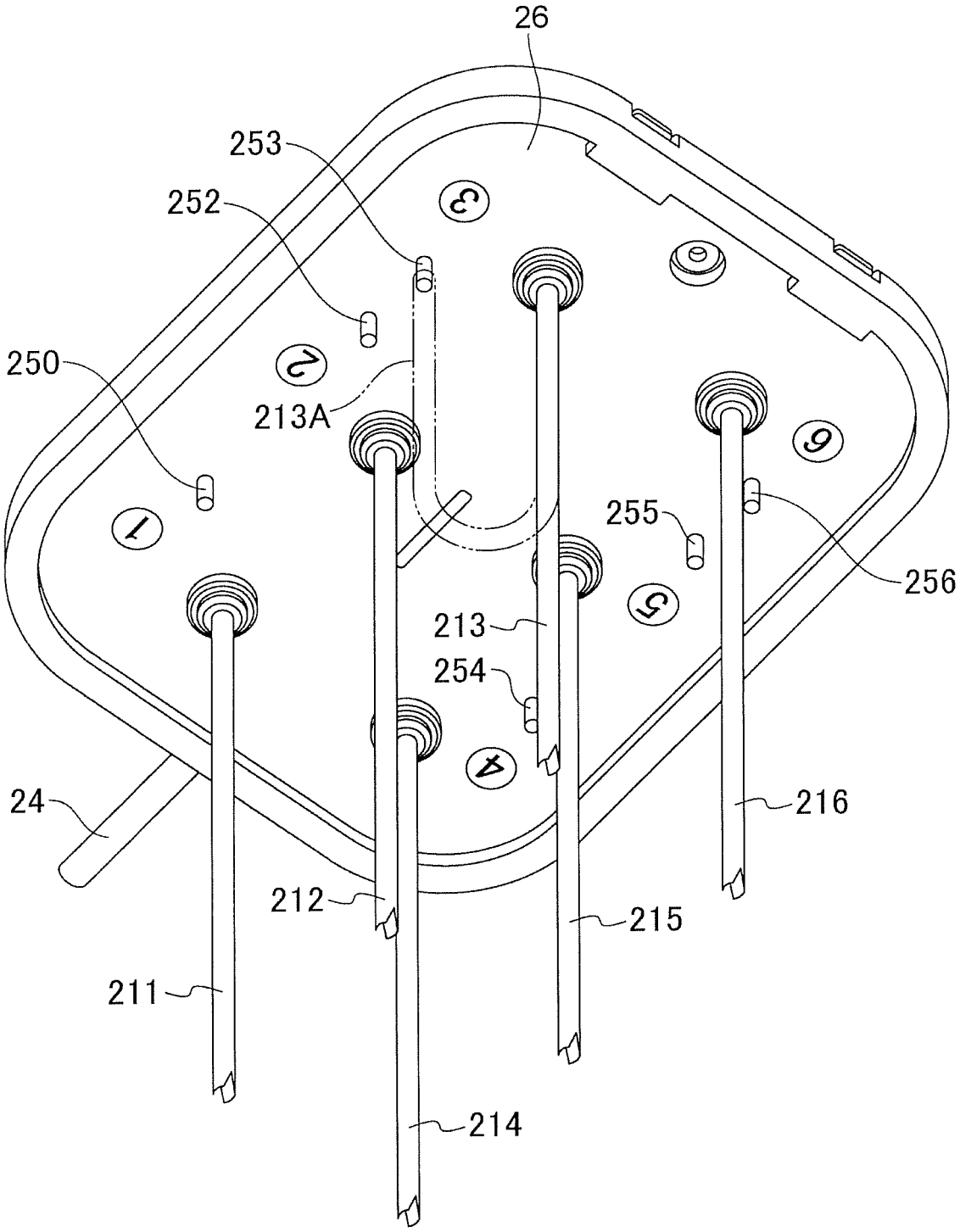
FIG. 14 is a perspective view of the inner lid of the second embodiment viewed from the under surface side.
Figure 15:
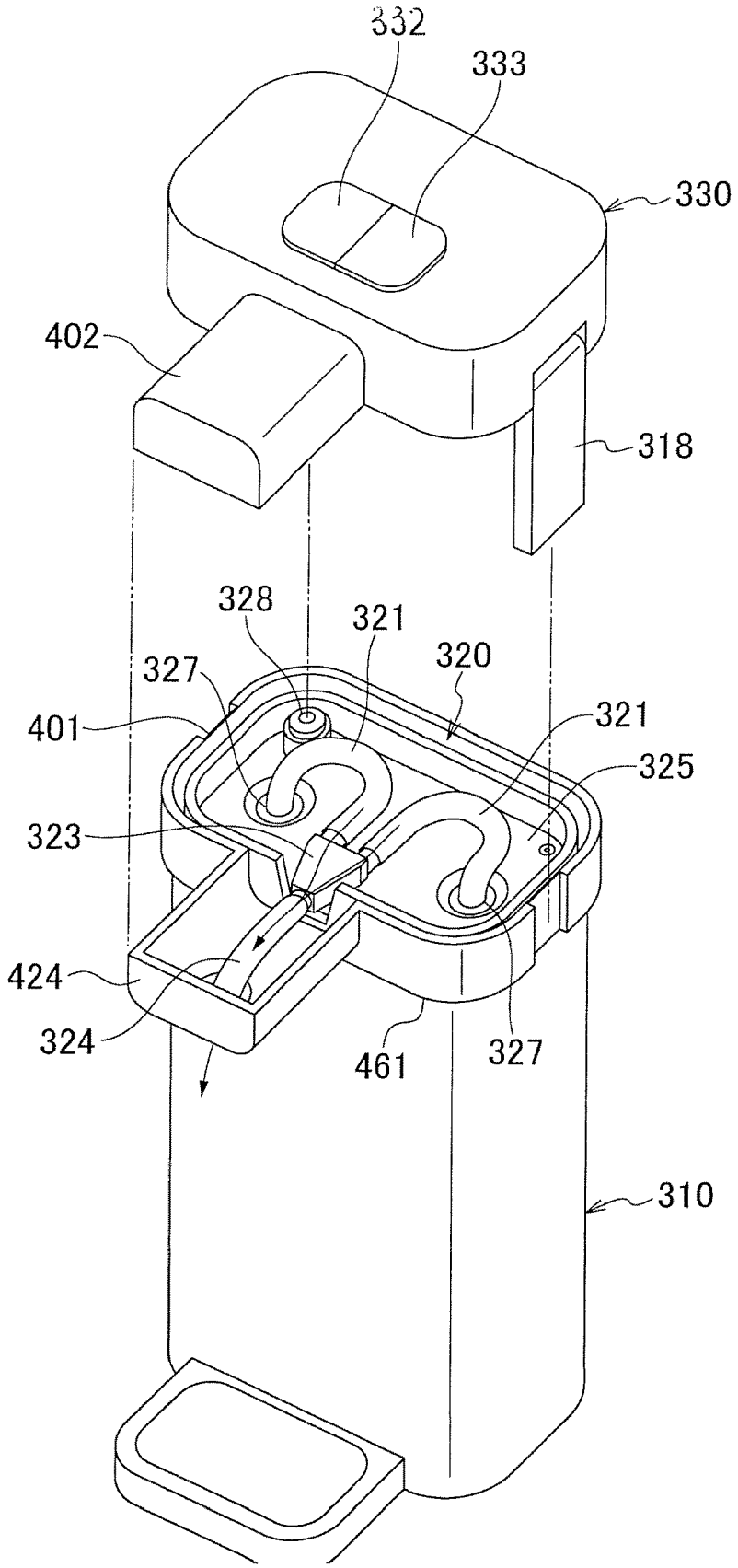
FIG. 15 is an exploded perspective view illustrating a third embodiment of a beverage server according to the present invention.
Figure 16:
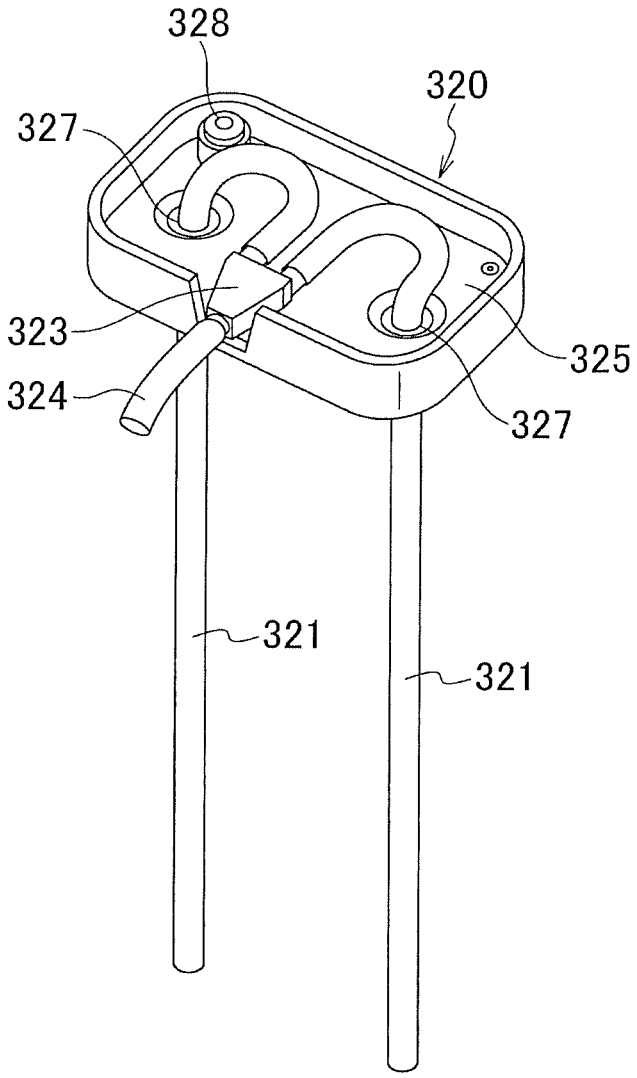
FIG. 16 is a perspective view illustrating an inner lid in the third embodiment.

In FIGS. 12 to 14, six liquid pumping pipes 211, 212, 213, 214, 215, and 216 hang down from the under surface of a lower plate 26 that constitutes an inner lid 20. The liquid pumping pipes 211 to 216 have equal cross sectional areas and equal overall lengths. The projection lengths of the liquid pumping pipes 211 to 216 from the under surface of the inner lid 20 are the same, and longer than the distance from the under surface of the inner lid 20 to the bottom of a beverage can 60 to be accommodated in a can accommodation space 14 of a main body 10.

On a lower plate 26 of the inner lid 20, six holes 260, 262, 263, 264, 265, and 266 through which six liquid pumping pipes 211 to 216 respectively penetrate in the vertical direction are formed corresponding to the positions of six beverage cans to be accommodated in the main body 10. The end portions of the liquid pumping pipes 211 to 216 penetrating through the holes 260 to 266 from the under surface side to the top surface side of the lower plate 26 are connected to a joining part 230 fixed to the top surface of the lower plate 26, and the internal spaces of the liquid pumping pipes 211 to 216 communicate with the joining part 230 in a sharing manner. At the joiningpart 230, joints that individuallyjoin the liquid pumping pipes 211 to 216 are provided.

The lengths of the liquid pumping pipes 211 to 216 from the positions of the holes 260 to 266 to the joints of the joining part 230 are the same. In contrast to this, the distances from the joining part 230 to the holes 260 to 266 through which the liquid pumping pipes 211 to 216 penetrate are varied. Thus, the liquid pumping pipe that penetrates through the hole near the joining part 230 makes a long bypass with a large arc, whereas the liquid pumping pipe that penetrates through the hole far from the joining part 230 makes a short bypass with a small arc.

On the inner lid 20 on the opposite side of the can accommodation space 14 of the main body 10, i.e. on the top surface side of the lower plate 26 constituting the inner lid 20, guide walls 221 to 226 that respectively hold the liquid pumping pipes 211 to 216 are formed. In the guide walls 221 to 226, the guide wall of the liquid pumping pipe having a large bypass amount depicts a large arc, whereas the guide wall of the liquid pumping pipe having a small bypass amount depicts a small arc and a straight line in association with the bypass amounts of the liquid pumping pipes 211 to 216. An overlay portion where the liquid pumping pipes are placed over each other is present. At the portion, the guide wall is high.

One ends of the guide walls 221 to 226 are disposed near the corresponding holes 260 to 266, and the other ends of the guide walls 221 to 226 are directed to the corresponding joints of the joining part 230. The liquid pumping pipes 211 to 216 are held on the corresponding guide walls 221 to 226, and hence the pipes 211 to 216 are held at predetermined positions with no unnecessary move. The lengths of the liquid pumping pipes 211 to 216 hanging down from the under surface side of the inner lid 20 are also maintained with no variations.

In the second embodiment, the liquid pumping pipes 211 to 216 are directly joined to the joining part 230, and the valves 27 of the first embodiment are omitted. Thus, in the state where the number of beverage cans that are accommodated in the can accommodation space 14 where six beverage cans are accommodatable is less than six, the can accommodation space 14 is opened to the atmosphere through a part of the liquid pumping pipes, resulting in a failure of supply of a beverage.

Therefore, as shown in FIG. 14, on the under surface of the lower plate 26 of the inner lid 20, plugs 250, 252, 253, 254, 255, and 256 are projected respectively to the liquid pumping pipes 211 to 216. The tip end portions of the liquid pumping pipes 211 to 216 can be fit over the plugs 250 to 256. In FIG. 14, the state where the tip end portion of the liquid pumping pipe 213 is fit over the plug 253 is depicted by phantom lines 213A. In the case in which the number of the beverage cans to be accommodated in the can accommodation space 14 is less than six, the tip end portion of the liquid pumping pipe that is not used is fit over the corresponding plug as described above such that the can accommodation space 14 is not opened to the outside air through the liquid pumping pipe.

The second embodiment also exerts the effect similar to the first embodiment. In addition to this, according to the second embodiment, in the constitution, the liquid pumping pipes 211 to 216 are directly connected to the joining part 230. Thus, the connecting passage 22 of the first embodiment is eliminated, and the inner lid 20 has a simple constitution.

As in the second embodiment, the liquid pumping pipes 211 to 216 have equal cross sectional areas and equal lengths, and hence the beverage can be equally supplied from the beverage cans. The provision of the valves 27 of the first embodiment is an option. The plugs 251 to 256 may be provided instead of the valves 27.

Third Embodiment

Next, a third embodiment of a beverage server shown in FIGS. 15 to 18 will be described. The main point of the third embodiment different from the second embodiment is that the number of accommodatable beverage cans is two.

The third embodiment of the beverage server shown in FIGS. 15 to 18 has a main body 310, an inner lid 320, and an outer lid 330. The inner lid 320 is mainly composed of a plate 325. Two liquid pumping pipes 321 hang down from the under surface of the plate 325. The liquid pumping pipes 321 have equal cross sectional areas and equal overall lengths. The projection lengths of the liquid pumping pipes 321 from the under surface of the inner lid 320, i.e. from the under surface of the plate 325 are equal, and longer than the distance from the under surface of the inner lid 320 to the bottom of a beverage can 60 to be accommodated in a can accommodation space 314 of the main body 310.

On the plate 325 of the inner lid 320, two holes through which two liquid pumping pipes 321 individually penetrate in the vertical direction are formed corresponding to the positions of two beverage cans 60 to be accommodated in the main body 310. A bushing 327 is fit into each of the holes, and the liquid pumping pipes 321 individually penetrate through the bushings 327. The end portions of the liquid pumping pipes 321 that penetrate from the under surface side to the top surface side of the plate 325 are connected to a joining part 323 fixed to the top surface side of the plate 325, and the internal spaces of the liquid pumping pipes 321 communicate with the joining part 323 in a sharing manner. On the joining part 323, joints that individually join the liquid pumping pipes 321 are provided.

The liquid pumping pipes 321 make a bypass in symmetry on the top surface side of the plate 325 with an arc, and reach the joining part 323. To the joining part 323, a beverage discharge pipe 324 is joined on the opposite side of the joint joining the liquid pumping pipes 321. The beverage discharge pipe 324 extends frontward in a protrusion 424 formed at the top end portion of the front surface of the main body 310. The tip end of the beverage discharge pipe 324 protrudes diagonally downward from the protrusion 424 through a hole formed on the protrusion 424.

Figure 17:
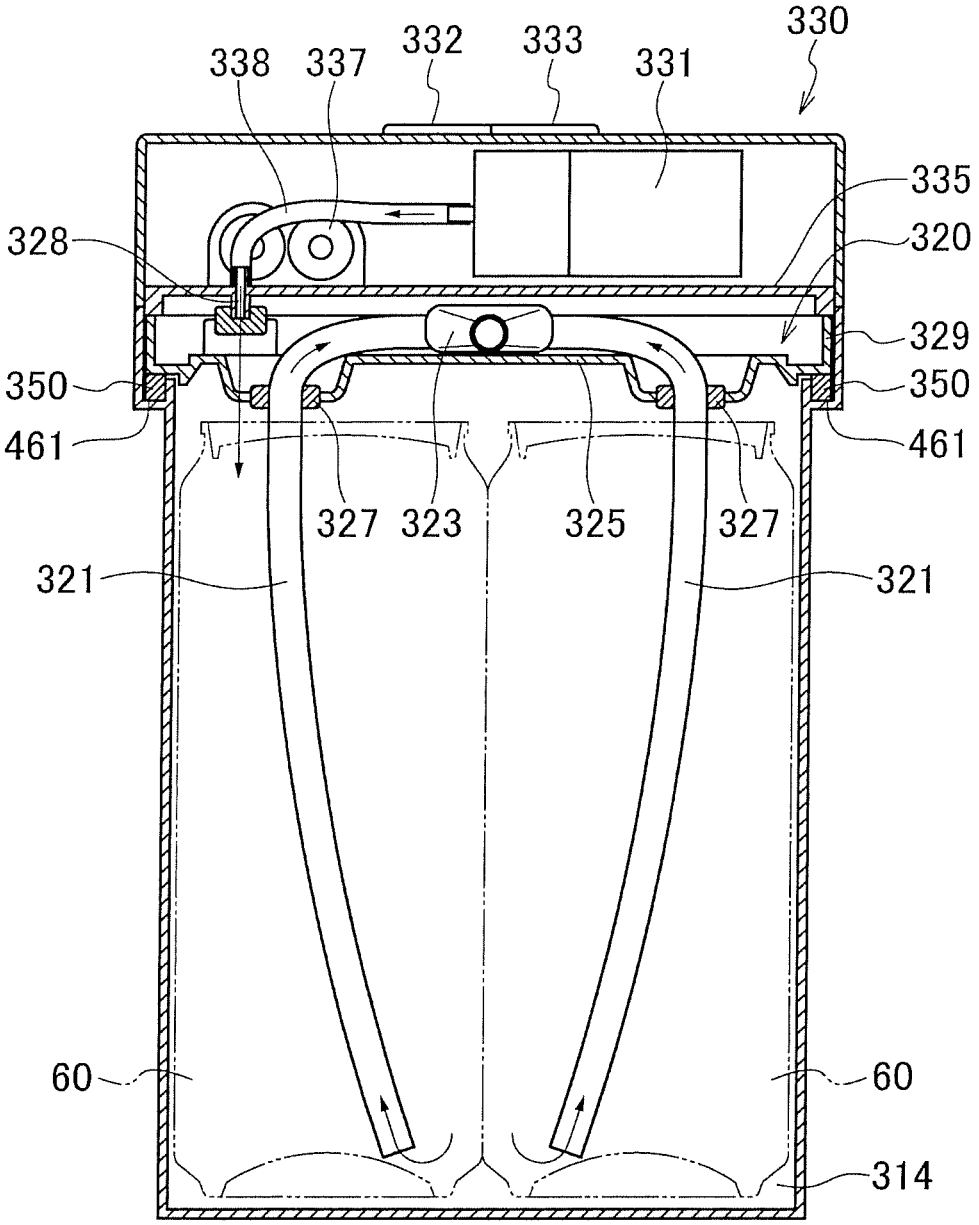
FIG. 17 is a front cross sectional view of the third embodiment.
Figure 18:
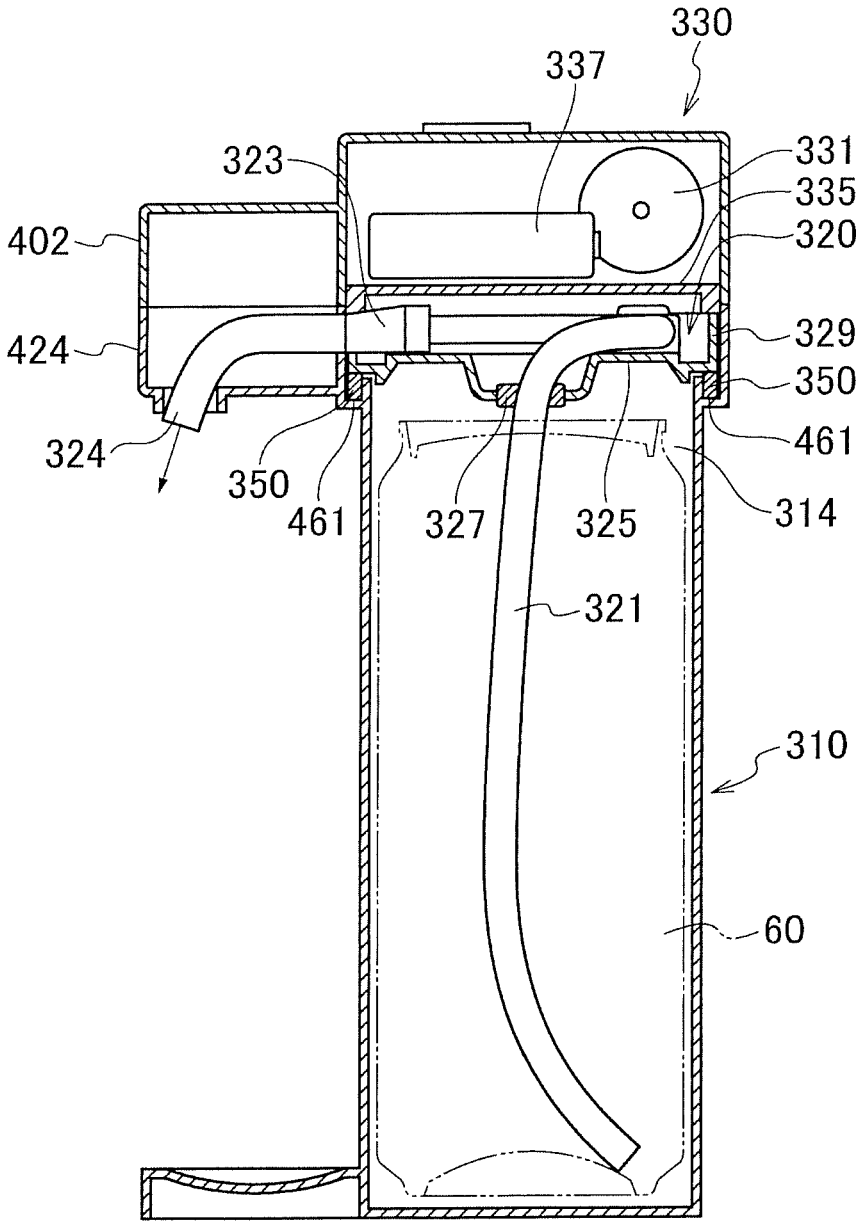
FIG. 18 is a right side cross sectional view of the third embodiment.

As shown in FIGS. 17 and 18, a jaw 461 is formed entirely around the main body 310; the entire circumference near the top end of the main body 310 is expanded to the outer side. A groove is formed at a portion on the inner circumference side of the main body 310 on the entire circumference of the main body 310 corresponding to the jaw 461, and a packing 350 is fit into this groove. The inner lid 320 is dropped on the inner circumference side of the top end portion of the main body 310, the circumference of which is expanded. The inner lid 320 has a protruding edge 329 in a shape in which the outer peripheral part is bent upward. The inner lid 320 is held in the main body 310 in which the outer peripheral part of the under surface of the plate 325 is placed on the top surface of the packing 350.

In the state where the inner lid 320 is dropped on the inner circumference of the top end portion of the main body 310, the outer lid 330 is put on the top end of the main body 310. The outer lid 330 has its lower end surface in the same shape as the top end surface of the main body 310, and a protrusion 402 that blocks the opened top end of the protrusion 424 of the main body 310 is integrally molded. The outer lid 330 can block the top end opening of the main body 310 by placing the outer lid 330 on the top end of the main body 310.

The lower end portion of the outer lid 330 is blocked with a bottom plate 335 fit into the inner circumference side of the outer lid 330. The outer peripheral part of the bottom plate 335 is fixed to the outer lid 330, protruding downward to some extend below the lower end of the outer lid 330. The protruding outer peripheral part of the bottom plate 335 is fit on the inner peripheral part of the top end of the main body 310. The lower end of the outer peripheral part of the bottom plate 335 is abutted against the top end of the protruding edge 329 of the plate 325 of the inner lid 320.

In the outer lid 330, a space is provided in the inside by the main body having a cup shape upside down and the bottom plate 335, and a motor-equipped pump unit 331 and a battery 337 that is the drive power supply of the pump unit 331 are accommodated in this space.

The outer lid 330 has buckles 318 that maintain the joining state of the main body 310 to the outer lid 330. The buckles 318 are hooked on the jaw 461 of the main body 310 in the state where the outer lid 330 is put on the main body 310, and the buckles 318 join the outer lid 330 to the main body 310 in the state where the outer lid 330 is brought to the main body 310 to maintain the joining state. In the state where the main body 310 is joined to the outer lid 330 with the buckles 318, the inner lid 320 is pressed against the main body 310 with the presence of the packing 350, and the can accommodation space 314 of the main body 310 is hermetically kept.

In the state where the main body 310 is joined to the outer lid 330 with the buckles 318, an air supply pipe 338 extending from the pump unit 331 in the outer lid 330 is joined to an air receiving port 328 provided on the inner lid 320. The air supply pipe 338 is joined to the air receiving port 328, and hence compressed air can be fed from the pump unit 331 to the can accommodation space 314 of the main body 310.

On the top surface of the outer lid 330, a beverage supply manipulation button 332 and a bubble supply manipulation button 333 are provided side by side. When the beverage supply manipulation button 332 is manipulated, the pump unit 331 is operated, and compressed air is fed from the pump unit 331 to the can accommodation space 314. When the air pressure in the beverage cans 60 accommodated in the can accommodation space 314 is increased, the beverage in the beverage cans 60 is pushed up into the liquid pumping pipes 321, and the beverage is discharged through the joining part 323 and the beverage discharge pipe 324. The bubble supply manipulation button 333 is used to supply bubbles in the case in which the beverage is beer, for example.

In the case in which one beverage can 60 alone is accommodated in the can accommodation space 314, a plug that is fit into the tip end of the liquid pumping pipe 321 that is not usedmay be provided as described in the second embodiment.

The third embodiment described above has substantially the same constitution as the constitution of the second embodiment, only except that the number of canned beverages to be accommodated in the main body is different. The third embodiment has the same use method, operation, and effect as those of the second embodiment. Therefore, the description of the use method, operation, and effect of the third embodiment is omitted.

Note that in any embodiment, the inner lid may be integrated with the outer lid. In such a constitution, the server is roughly separated into a main body and a cover.

The invention claimed is:

1. A beverage server comprising:

a main body having a space, the main body having a top end opened;

an inner lid disposed on an upper part of the main body; and an outer lid put on the top end of the main body with the inner lid covered, the outer lid being configured to make the space hermetic, wherein the inner lid has a plurality of liquid pumping pipes to be inserted into the space, and a beverage discharge pipe communicating with the liquid pumping pipes, the beverage discharge pipe being configured to discharge a beverage from the space to outside the main body, the outer lid has a pump configured to feed air to the hermetic space, and a manipulation member configured to switch between discharging a beverage and discharging no beverage, and the pump is operated by switching the manipulation member to discharging a beverage.

2. The beverage server according to claim 1, wherein the inner lid has a valve operable to open and close the liquid pumping pipes individually.

3. The beverage server according to claim 1, wherein the outer lid has an ultrasonic generator adjacent to the beverage discharge pipe.

4. The beverage server according to claim 1, wherein the main body has a double structure formed of an outer wall and an inner wall, and a space between the outer wall and the inner wall is filled with a heat insulator.

5. The beverage server according to claim 1, wherein a passage of air from the pump is separated into two passages, and one of the passages communicates with the space of the main body, and another of the passages communicates with the exhaust pipe.

6. The beverage server according to claim 1, wherein the space is formed of the main body and the inner lid, a packing is present at a coupling part of the main body to the inner lid, and the outer lid presses the inner lid against the main body to make the space hermetic by the packing.

7. A beverage server comprising:

a main body having a can accommodation space in which a plurality of beverage cans is accommodatable, the main body having a top end opened;

an inner lid disposed on an upper part of the main body; and an outer lid put on the top end of the main body with the inner lid covered, the outer lid being configured to make the can accommodation space hermetic, wherein the inner lid has a plurality of liquid pumping pipes insertable into the individual beverage cans, and a beverage discharge pipe communicating with the liquid pumping pipes, the beverage discharge pipe being configured to discharge a beverage from the can accommodation space to outside the main body, the outer lid has a pump configured to feed air to the hermetic can accommodation space, and a manipulation member configured to switch between discharging a beverage and discharging no beverage, and the pump is operated by switching the manipulation member to discharging a beverage.

8. The beverage server according to claim 7, wherein the liquid pumping pipes have a length longer than a distance from a bottom surface of the inner lid to a bottom of the beverage can to be accommodated in the can accommodation space, and the liquid pumping pipes have a tip end formed in a V-shape.

9. The beverage server according to claim 7, comprising a low-temperature insulator formed in a shape that buries a space between the plurality of beverage cans to be accommodated in the can accommodation space.

10. The beverage server according to claim 7, wherein an electric component including the pump is installed in only the outer lid.

11. A beverage server comprising:

a main body having a can accommodation space in which a plurality of beverage cans is accommodatable, the main body having a top end opened;

an inner lid disposed on an upper part of the main body; and an outer lid put on the top end of the main body with the inner lid covered, the outer lid being configured to make the can accommodation space hermetic, wherein the inner lid has a plurality of liquid pumping pipes insertable into the individual beverage cans, a joining part communicating with internal spaces of the liquid pumping pipes collectively, and a beverage discharge pipe communicating with the joining part, the beverage discharge pipe being configured to discharge a beverage from the beverage cans to outside the main body, the outer lid has a pump configured to feed air to the hermetic can accommodation space, a manipulation member configured to switch between discharging a beverage and discharging no beverage, and an exhaust pipe communicating with the can accommodation space of the main body, the exhaust pipe being opened and closed by manipulation of the manipulation member, the pump is operated by switching the manipulation member to discharging a beverage, and the beverage server includes an opening and closing mechanism configured to close the exhaust pipe when the manipulation member is switched to discharging a beverage, and open the exhaust pipe when the manipulation member is switched to discharging no beverage.

12. The beverage server according to claim 11, wherein the inner lid has a connecting passage between the plurality of liquid pumping pipes and the joining part, and the connecting passage connects the plurality of liquid pumping pipes individually to the joining part.

13. The beverage server according to claim 12, wherein the inner lid has a structure in which a plate is vertically placed over another plate, and a groove formed on at least one of the plates constitutes the connecting passage.

14. The beverage server according to claim 13, wherein a recess formed on the one plate constitutes the joining part.

15. The beverage server according to claim 12, wherein the individual liquid pumping pipes and the individual connecting passages connecting to the liquid pumping pipes have equal cross sectional areas and equal overall lengths.

16. A beverage server comprising:

a main body having a can accommodation space in which a plurality of beverage cans is accommodatable, the main body having a top end opened; and a cover put on the top end of the main body, the cover being configured to make the can accommodation space hermetic, wherein the cover has a plurality of liquid pumping pipes insertable into the individual beverage cans, a beverage discharge pipe communicating with the liquid pumping pipes, the beverage discharge pipe being configured to discharge a beverage from the can accommodation space to outside the main body, a pump configured to feed air to the hermetic can accommodation space, a manipulation member configured to switch between discharging a beverage and discharging no beverage, and an exhaust pipe communicating with the can accommodation space of the main body, the exhaust pipe being opened and closed by manipulation of the manipulation member, the liquid pumping pipes have equal cross sectional areas and equal overall lengths, the pump is operated by switching the manipulation member to discharging a beverage, and the beverage server includes an opening and closing mechanism configured to close the exhaust pipe when the manipulation member is switched to discharging a beverage, and open the exhaust pipe when the manipulation member is switched to discharging no beverage.

17. The beverage server according to claim 16, wherein the cover has a joining part between the communicating passages and the beverage discharge pipe, and the joining part communicates with internal spaces of the liquid pumping pipes collectively.

18. The beverage server according to claim 16, wherein the cover has a guide wall on a side opposite to the can accommodation space of the main body, and the guide wall holds the liquid pumping pipes such that the guide wall makes a bypass with an arc.

* * * * *